United States Patent [19]

de Blanitza

[11] Patent Number: 4,895,542

[45] Date of Patent: Jan. 23, 1990

[54] TOY AUTOMOBILE WITH ATTACHMENTS

[76] Inventor: Marc F. de Blanitza, 5, rue Coste, F-69300 Caluire, France

[21] Appl. No.: 269,153

[22] Filed: Nov. 9, 1988

[30] Foreign Application Priority Data

Nov. 10, 1987 [FR] France ..... 87 16295

[51] Int. Cl.[4] ..... A63H 17/26

[52] U.S. Cl. ..... 446/94; 446/427; 446/471

[58] Field of Search ..... 446/88, 93–96, 446/471, 470, 427, 465

[56] References Cited

U.S. PATENT DOCUMENTS

| | | | |
|---|---|---|---|
| 1,728,725 | 9/1929 | Dowst | 446/471 |
| 2,587,142 | 2/1952 | Gray et al. | 446/94 |
| 3,082,569 | 3/1963 | Albiani | 446/471 |
| 3,811,218 | 5/1974 | Salmon et al. | 446/94 |
| 3,962,820 | 6/1976 | Good et al. | 446/471 |
| 4,631,040 | 12/1986 | Shiraishi | 446/94 X |

FOREIGN PATENT DOCUMENTS

| | | | |
|---|---|---|---|
| 457389 | 11/1936 | United Kingdom | 446/95 |

*Primary Examiner*—Mickey Yu
*Attorney, Agent, or Firm*—Herbert Dubno

[57] ABSTRACT

A toy automobile has slot-like formations on wide various surfaces to accommodate accessories and body elements which have circular clip elements snugly receivable removably in these recesses. The recesses can be paired with the recesses of each pair lying at right angles, e.g. in the form of a Greek cross. The accessories can include antenna, fuel can, windshield, headlight, car-transporter, car-flipping windlass, light, mirror and police elements, while the body elements can include caps for the back and driver's compartment, wheels and the like.

20 Claims, 3 Drawing Sheets

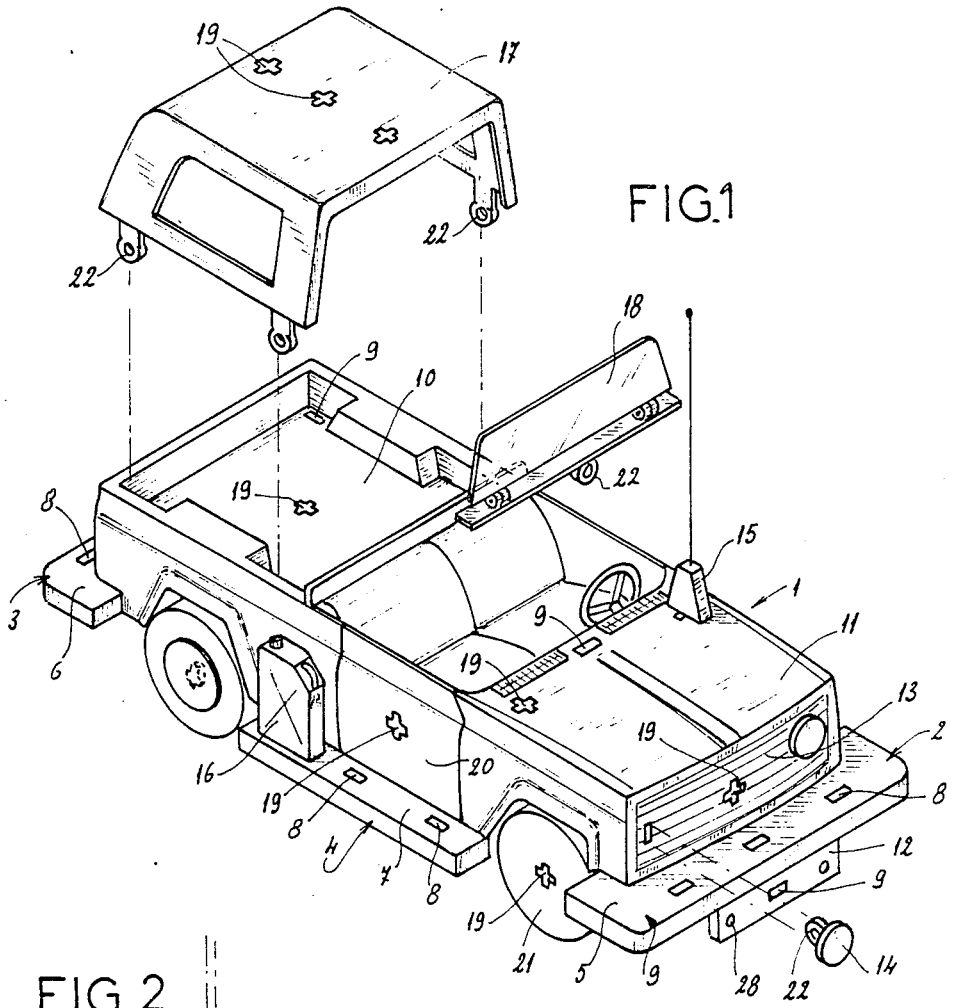
FIG. 1
FIG. 2
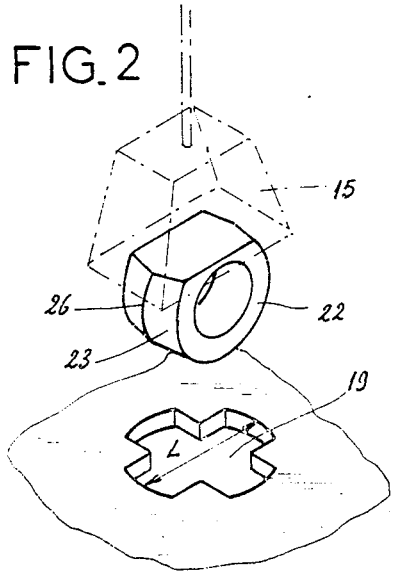
FIG. 3
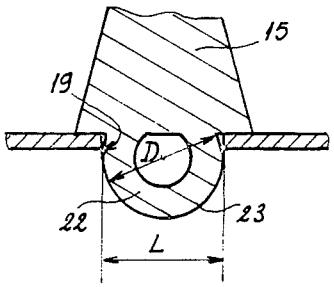

TOY AUTOMOBILE WITH ATTACHMENTS

FIELD OF THE INVENTION

My present invention relates to a miniature toy automobile with a high degree of versatility and constructed to enable a variety of attachments and accessories to be applied and hence the configuration or conformation of the toy automobile to be easily modified or altered by a child.

BACKGROUND OF THE INVENTION

Miniature automobiles are provided in large numbers as play things for children and seldom can be modified as to configuration, conformation, association of body parts and attachment of accessories at will and in a creative and versatile manner by the child. In some cases, a toy automobile can be assembled from parts but generally such automobile requires that each part be attached in a particular location conforming to a predetermined configuration.

In most cases, however, the toy automobile, whether assembled from a kit or delivered in its completed stated, offers a minimum of opportunity for alteration and practically no opportunity for significant variation, thereby limiting the free run of the imagination of the child.

OBJECTS OF THE INVENTION

It is, therefore, the principal object of the present invention to provide a toy automobile which can bring out the creative abilities of a child more fully than earlier miniature automobile toys.

Another object of the invention is to provide a highly versatile toy automobile with a myriad of attachments and accessories so that a particular plaything can be assembled in a practically unlimited number of variations and possibilities, thereby expanding the imaginative field of the toy.

A further object of this invention is to provide a toy automobile which is easy to handle, can be provided with accessories and attachments in a rapid and variable manner, and can be assembled or disassembled with relative ease.

Finally, it is an object of this invention to provide an improved toy automobile which is free from drawbacks of earlier toy structures of this type.

SUMMARY OF THE INVENTION

These objects are attained, in accordance with the present invention with a miniature toy automobile which can be rapidly transformed to any desired configuration and thus permitting free rein to the creative imagination of the child.

This toy automobile is provided with bumpers on the front and the rear of the automobile body and which extend significantly forwardly and rearwardly therefrom, as well as elongated running boards which are of the same width on either side of the body. On the upper faces of the bumpers and running boards, I can provide points of rapid attachment, all of which are identical, and which are adapted to receive accessories or body elements of a vehicle.

Other points of rapid attachment identical to those described are provided at other locations on the chassis and, if desired, on the wheel and bumpers of the miniature vehicle body so that certain other accessory elements and/or movable and removable elements of the body can be interchangeably attached at the various locations by the child.

Specifically, the toy automobile of the present invention can comprise:

an elongated body having a shape generally of an automotive vehicle with a driver's compartment having doors;

front and rear bumper members affixed to the body at a front and a rear thereof, respectively, and having upper generally horizontal surfaces extending substantially beyond the body in a front and a rear direction respectively;

running-board members affixed to the body along opposite sides thereof beneath the doors and extending from the body with substantially equal widths, the running-board members having generally horizontal upper surfaces, the body being formed with additional outer surfaces including both substantially vertical and substantially horizontal surfaces;

at least one rapid-connection formation provided on each of the surfaces, all of the rapid-connection formations being functionally identical;

a set of automobile accessories each having a rapid-connection formation detachably matingly engageable with substantially any of the rapid-connection formations of the surfaces for selective positioning of the accessories removably on the surfaces; and at least one removable body element having at least one rapid-connection formation detachably matingly engageable with at least certain of the rapid-connection formations of the surfaces of the body for removable attachment of the element to the body.

Preferably, the points of rapid attachment are constituted by generally rectangular, elongated recesses which can be individual or grouped, for example, in pairs. Where the attachment recesses are paired, according to the invention, the two recesses of each pair can adjoin angularly, preferably at a right angle, for example in the form of a Greek cross, or an L or a T.

The accessory and body elements are equipped with projections which constitute configurations mating with those constituted by the recess, preferably forming clips adapted to be pressed tightly into the rectangular recesses in order to removably attach the accessories or body elements to the body of the toy automobile. Stated more generally, therefore, the accessory and body elements can have formations mating with those of the body and constituting rapid-connection attachments therewith.

Advantageously, the clips can be composed of a semi-rigid material having an external profile which is substantially circular and either forms a complete or partial circle although, in the case of the partial circle, the clip should be more than a semicircle. The diameter of the circle can be slightly greater than the recesses into which it can be pressed so that the elasticity of the material constituting the clip will enable introduction of the clip into the recess, passing through a "hard point" requiring a maximum force and which is the same for insertion of the projection and its withdrawal.

BRIEF DESCRIPTION OF THE DRAWING

The above and other objects, features and advantages of the present invention will become more readily apparent from the following description, reference being made to the accompanying drawing in which:

FIG. 1 is a partially exploded perspective view of a toy vehicle according to the invention;

FIG. 2 is a perspective view drawn to a larger scale showing the cooperation of the mating formations of the invention, i.e. the recesses in the form of a Greek cross on the vehicle body and the projection or clip from an accessory element such as an antenna;

FIG. 3 is a vertical section through the assembled joint of FIG. 2;

SPECIFIC DESCRIPTION

Figure 5:
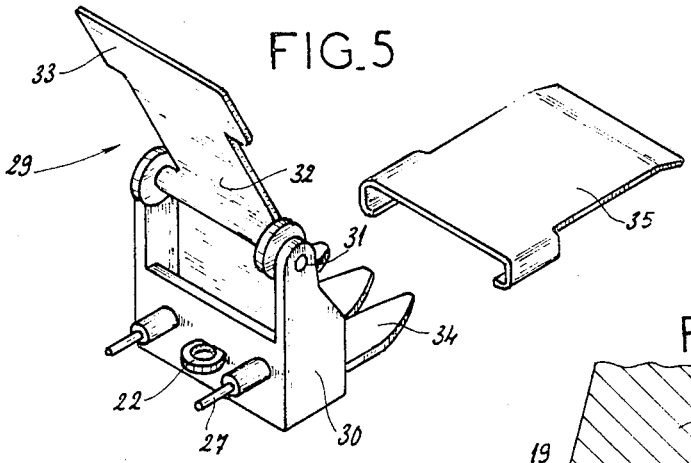
FIG. 5 is a perspective view of a platform or fork attachment for the vehicle, adapted to be fitted on the front or rear thereof and which can be utilized for transportation or flipping of another miniature assembly.

In the more detailed explanation of the invention which follows, reference may be made to a variety of accessories and body elements which can be assembled to the body of a toy vehicle. These accessory elements or body elements may simulate working parts or, when provided with appropriate electrical connections, can even constitute working parts themselves. They have, however, been described and illustrated simply as simulations of actual automotive motor vehicle accessories and body elements and are intended, therefore, only to simulate these elements.

As can be seen from FIG. 1, the miniature toy automobile 1 comprises a body or chassis having a front and rear. A front-bumper member 2 and a rear-bumper member 3 are permanently affixed to and form part of the body and can have dimensions which are disproportionately greater than the front and rear bumpers normally provided on an automobile. As shown, these bumper members have horizontal upper surfaces and extend generously vertically and rearwardly of the remainder of the body. Similarly, the body is formed with two relatively wide-surface running-board members 4 which are highly elongated and which extend over the lateral sides of the vehicle well beyond, in the door region which may be provided on the vehicle.

Both the bumper members 2 and 3, and the running-board members 4, are sufficiently wide so that their horizontal upper surfaces 5, 6, 7 form a surface plane of dimensions sufficient to allow elongated generally rectangular recesses 8 to be provided in these surfaces, these recesses being all identical to one another. The recesses or slots 8 in the bumper members 2, 3 and in the running-board members 4 can extend entirely through the upper surfaces and can be of rectangular section.

Other rapid-connection formations 9 are provided at other points on the chassis or body.

For example, such formations 9 can be provided at each corner of a rear platform 10 of the body. One can be provided, as shown, at the center rear of the hood 11. Another can be provided at the center of a vertical plate 12 which may be located at the front of the front bumper 2 (a rear plate can be similarly provided on the rear bumper). An additional recess 9 of this type can be provided as well on each side of the grill 13 at the front of the toy automobile.

The formations 8 and 9 constitute points of rapid attachment of the accessories which can be provided in a set together with a car body. Although other accessories than those described can be provided, the set should at least include the headlights 14, an antenna 15, a spare fuel can 16. The additional body elements which may be provided in the set can include a windshield 18, a rear cap 17 or the body or accessory elements illustrated in and described with respect to FIGS. 10 and 17.

The formations 8 and 9 are isolated from one another, i.e. are spaced apart. For the greatest versatility some of the formations are provided in pairs as shown at 19 in the form of a Greek cross to enable the accessories to be attached in different orientations.

Such paired formations are provided, for example, at the center of the doors 20 of the vehicle, at the center of the grill 13, at the center of the rear platform 10, along the axis of each wheel 21 which is attached to the body. Two such Greek cross formations are provided on the hood 11 at either side thereof and three such formations on the top of the cap 17.

Each pair of recesses is formed with two recesses identical to the recesses 8 or 9 adjoining at a right angle. The paired recesses, can, of course, form another shape, such as L or a T, if desired.

The recesses are all designed to receive interchangeable complementary formations which have been referred to as projections and have been indicated, for example, at 22 in FIGS. 1–3.

These projections are of generally annular or ring shape and form clips. The clip 22 serving to attach the antenna 15 has been shown in larger scale in FIGS. 2 and 3.

The clip 22 is composed of a semirigid synthetic resin material which can be molded unitarily with the base of the antenna (FIGS. 2 and 3) although in general, it will be molded unitarily with the accessory. The clip has a configuration of $\frac{3}{4}$ of a circle, with a diameter D very slightly greater than the length L of the corresponding elongated recesses in which it is to be received. The elasticity of the material constituting the partial annulus 22 allows it to be compressed as it is forced into the recess and to lock therein after passage of a hard point during insertion. It can be removed past this hard point with an equal extraction force.

Figure 4:
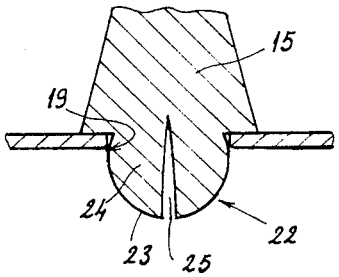
FIG. 4 is a view similar to FIG. 3 showing a different construction of the projection or clip but functioning similarly.

The projection 22 can have a shape other than the annular shape shown in FIGS. 2 and 3. For example, in FIG. 4, the clip 22' has a circular outer profile 23' but is divided by a split 25 into two segments 24 which can be pressed together upon insertion of the clip into the recess or slot 8 or 9 as described.

To facilitate the interlocking effect, the clips 22, 22' have their outer peripheries 23, 23' so shaped that a junction 26 is provided in a plane from which the surface 23 frustoconically tapers in opposite directions.

The toy vehicle is thus provided with a set of accessories or body elements which can be removed and reapplied and can be connected in a variety of patterns or ways. Some of these accessory or body elements have already been described.

Figure 6:
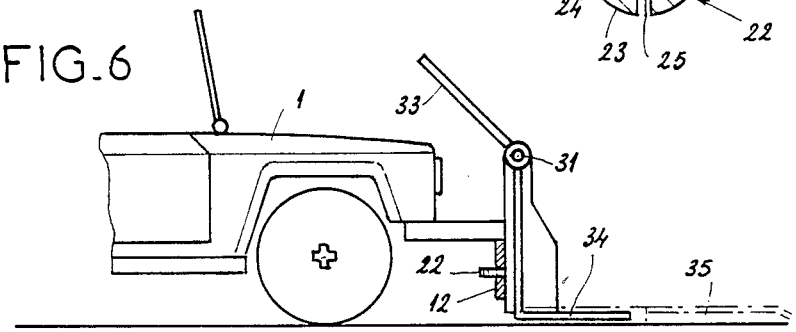
FIG. 6 is a side-elevational view showing the latter attachment mounted on the toy car.

In FIGS. 5 and 6, however, I show a carrier or flipping accessory with which another toy car can be transported or flipped over during play. For example, the device can comprise a base 30 which can be mounted on the front-bumper member of the vehicle by two cylindrical guides 27 which can have pins extending through holes 28 of the plate 12 and are disposed on opposite sides of a clip 22 engageable in the central slot 9 of this plate.

The base 30 has the shape of a U and on the two free ends of the arms of the U, only one of which is visible in FIGS. 5 and 6, pivots 31 are provided for a flipping plate 32 whose upper part 33 can be pressed in the counterclockwise sense (FIG. 6) to swing upwardly a fork 34 formed as the foot of the L. Thus if the child engages the fork 34 beneath another toy car and presses down on the plate 33, that other car can be flipped over.

On the teeth of the fork 34, a platform 35 can be fitted to extend the length of a supporting surface and allow another toy car to be driven up onto this platform and the accessory used for the transport of the other toy car.

Figure 7:
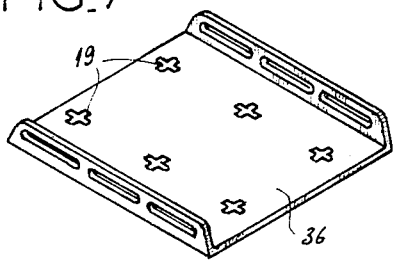
FIG. 7 is a perspective view of a platform accessory.
Figure 8:
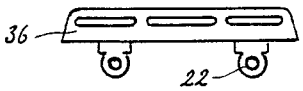
FIG. 8 is a side-elevational view thereof.

FIGS. 7 and 8 show a platform 36 whose clips 22 can engage in two of the paired recesses 19 of the cap 17 so that the platform 36 may form a roof-carrier for the vehicle.

Figure 9:
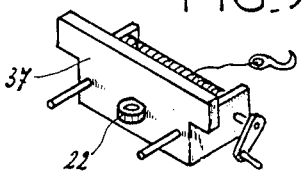
FIG. 9 is a perspective view of a windlass attachment which can be fitted to the front or rear of the vehicle, e.g. in place of or in addition to the attachment of FIGS. 5 and 6.

FIG. 9 shows a windlass 37 which can be mounted on the rear bumper-like accessory 29 of FIGS. 5 and 6 is mounted on the front bumper or on the front bumper in place of the latter.

Figure 10:
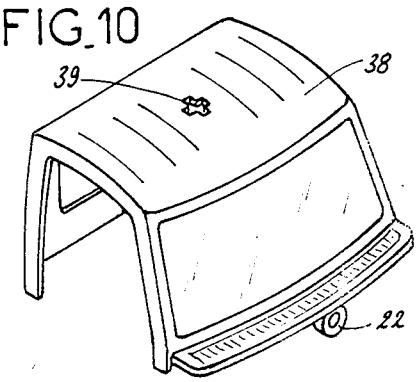
FIG. 10 is a perspective view of a body element in the form of a cap for the front or driver's compartment of the vehicle.
Figure 11:
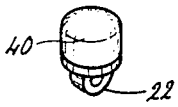
FIG. 11 is a perspective view of an accessory element having the appearance of a rotating emergency light for an emergency vehicle.
Figure 12:
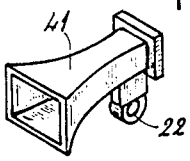
FIG. 12 is a perspective view of a loudspeaker attachment for a vehicle.
Figure 13:
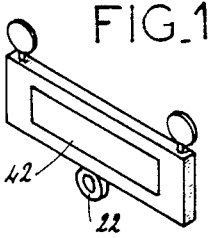
FIG. 13 is a perspective view of a display panel which can be used as an accessory for the vehicle.
Figure 15:
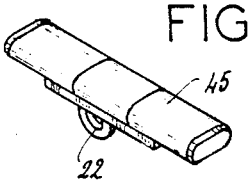
FIG. 15 is a perspective view of a police-type signal light which can be mounted on the hood or roof of the vehicle.

In FIG. 10, I have shown a cap for the driver's compartment of the vehicle, the cap 38 having a clip 22 which engages in the clip 9 of the hood 11 in place of the clip attaching the windshield 18. The cap 38 of FIG. 10, moreover, can have paired recesses 39 on which the rotary flasher 40 can be mounted or which can be used to mount the loudspeaker 41 of FIG. 12, the signal panel 42 of FIG. 13, or the police lights 45, shown in FIG. 15.

Figure 14:
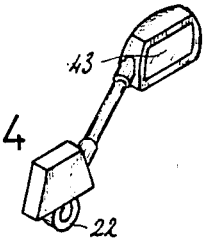
FIG. 14 is a perspective view of a side-view mirror for the vehicle.

FIG. 14 shows a side view mirror 43 which can be affixed, for example, to the paired recesses 19 of the hood 11 which is not provided with the antenna.

Figure 16:
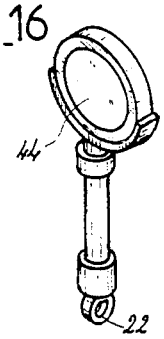
FIG. 16 is a perspective view of an additional headlamp or searchlight which can be mounted as an accessory element on the vehicle.
Figure 17:
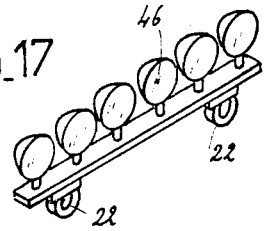
FIG. 17 is a perspective view of a light bar adapted to be mounted on the hood, roof or bumpers of the vehicle.

FIG. 16 shows an accessory headlight or floodlight or reflector 44 which can be mounted, like the fuel can 16, on one of the running boards 4 or elsewhere on the vehicle and FIG. 17 shows a light bar 46 which can be mounted on the upper surface 5 of the front bumper 2, or elsewhere as desired.

Of course the invention is not limited to the specific embodiment described but encompasses variations within the spirit and scope of the appended claims. For example, the body of the vehicle can be very different from that which has been illustrated and can correspond to a truck or some other automotive vehicle configuration. A set of other accessories can be provided. The accessories can include not only civilian accessories, but also military accessories. The same may apply for the body elements which can be attached. The formations for effecting the attachment may have different shapes and, of course, where I have shown recesses or slots, projections may be provided, and where the various elements have projections or clips, recesses can be used.

I Claim:

1. A toy automobile, comprising:

an elongated body having a shape generally of an automotive vehicle with a driver's compartment having doors;

front and rear bumper members affixed to said body at a front and a rear, thereof, respectively and having upper generally horizontal surfaces extending substantially beyond said body in a front and a rear direction respectively;

running-board members affixed to said body along opposite sides thereof beneath said doors and extending from said body with substantially equal widths, said running-board members having generally horizontal upper surfaces, said body being formed with additional outer surfaces including both substantially vertical and substantially horizontal surfaces;

at least one rapid-connection formation provided on each of said surfaces, all of said rapid-connection formations being functionally identical;

a set of automobile accessories each having a rapid-connection formation detachably matingly engageable with substantially any of said rapid-connection formations of said surfaces for selective positioning of said accessories removably on said surfaces; and at least one removable body element having at least one rapid-connection formation detachably matingly engageable with at least certain of said rapid-connection formations of said surfaces of said body for removable attachment of said element to said body.

2. The toy automobile defined in claim 1, further comprising wheel elements attached to said body.

3. The toy automobile defined in claim 2 wherein at least some of said elements have surfaces provided with rapid-connection formations identical to said functionally identical rapid-connection formations.

4. The toy automobile defined in claim 3 wherein each of said functionally identical rapid-connection formations is a generally rectangular recess formed in the respective surface.

5. The toy automobile defined in claim 4 wherein at least some of said functionally identical rapid-connection formations are provided in pairs of angularly adjoining formations.

6. The toy automobile defined in claim 5 wherein said angularly adjoining formations adjoin one another at a right angle.

7. The toy automobile defined in claim 6 wherein said angularly adjoining formations have the configuration of a Greek cross.

8. The toy automobile defined in claim 7 wherein said formations on said elements each is constituted as a clip of a semirigid material with a generally circular shape extending over more than a semicircle and with a diameter slightly greater than a length of said recess so that each of said clips is insertable into a selected one of said recesses with an insertion force overcoming a point of greatest resistance and is retained in the respective recess until a withdrawal force equal to said insertion force is applied.

9. The toy automobile defined in claim 8 wherein each of said clips has an external shape defining a joint plane and frustoconical surfaces tapering away from said joint plane.

10. The toy automobile defined in claim 8 wherein each of said clips is split.

11. The toy automobile defined in claim 8 wherein each of said clips has a generally ring shape.

12. The toy automobile defined in claim 1 wherein one of said accessories is provided with an L-shaped base having a horizontally extending leg and an upright leg, said upright leg being provided with formations matingly engageable with said formations on said body and with a plate swingably mounted on said base.

13. The toy automobile defined in claim 12 wherein said horizontally extending leg is a fork and said one of said accessories forms a fork transporter.

14. The toy automobile defined in claim 13, further comprising a platform member fittable removably onto said fork to transform said fork transporter into a platform transporter.

15. The toy automobile defined in claim 4 wherein said formations on said elements each is constituted as a clip of a semirigid material with a generally circular shape extending over more than a semicircle and with a diameter slightly greater than a length of said recess so that each of said clips is insertable into a selected one of said recesses with an insertion force overcoming a point of greatest resistance and is retained in the respective recess until a withdrawal force equal to said insertion force is applied.

16. The toy automobile defined in claim 15 wherein each of said clips has an external shape defining a joint plane and frustoconical surfaces tapering away from said joint plane.

17. The toy automobile defined in claim 15 wherein each of said clips is split.

18. The toy automobile defined in claim 15 wherein each of said clips has a generally ring shape.

19. The toy automobile defined in claim 15 wherein one of said accessories is provided with an L-shaped base having a horizontally extending leg and an upright leg, said upright leg being provided with formations matingly engageable with said formations on said body and with a plate swingably mounted on said base.

20. The toy automobile defined in claim 19 wherein said horizontally extending leg is a fork and said one of said accessories forms a fork transporter.

* * * * *

UNITED STATES PATENT AND TRADEMARK OFFICE

CERTIFICATE OF CORRECTION

PATENT NO. : 4,895,542

DATED : January 23, 1990

INVENTOR(S) : Marc FISCHER DE BLANITZA

It is certified that error appears in the above-identified patent and that said Letters Patent is hereby corrected as shown below:

Cover Page:

Item [19] should read -- Fischer de Blanitza -- and

Item [76] should read -- Marc Fischer de Blanitza -- .

Signed and Sealed this

Eighteenth Day of December, 1990

*Attest:*

HARRY F. MANBECK, JR.

*Attesting Officer*

*Commissioner of Patents and Trademarks*